United States Patent [19]

Showalter

[11] Patent Number: 4,493,292

[45] Date of Patent: Jan. 15, 1985

[54] HEAT PIPED PISTON

[75] Inventor: Merle R. Showalter, Madison, Wis.

[73] Assignee: Automotive Engine Associates, Madison, Wis.

[21] Appl. No.: 502,576

[22] Filed: Jun. 9, 1983

[51] Int. Cl.[3] ..... F01P 9/02

[52] U.S. Cl. ..... 123/41.2; 123/41.35; 123/193 P; 92/176

[58] Field of Search ..... 123/193 P, 193 R, 41.2, 123/41.35; 92/176

[56] References Cited

U.S. PATENT DOCUMENTS

| | | | |
|---|---|---|---|
| 1,363,708 | 12/1920 | Bennis | 123/41.35 |
| 1,678,957 | 7/1928 | Philipp | 92/176 |
| 2,865,348 | 12/1958 | Kramer et al. | 123/41.35 |
| 3,854,454 | 12/1974 | Lazaridis | 165/104.26 |
| 4,013,047 | 3/1977 | Harned | 123/41.2 |
| 4,321,898 | 3/1982 | Latsch | 123/254 |

*Primary Examiner*—Craig R. Feinberg

*Attorney, Agent, or Firm*—Witherspoon & Hargerst

[57] ABSTRACT

A piston having an evaporation-condensation heat pipe to transfer heat between piston crown and piston skirts. The evaporation-condensation heat pipe is formed as a structure separate from the piston itself, and the two are joined together by a high conductivity adhesive-elastomer bond.

3 Claims, 3 Drawing Figures

HEAT PIPED PISTON

BACKGROUND & OBJECTS

It is well established that the strength and hardness of aluminum pistons are reduced from room temperature values at piston operating temperatures. Also, piston thermal expansion significantly changes piston shape. This makes it extremely difficult to design the skirts as effective low friction bearings. It is the purpose of the present invention to provide a piston which has an inexpensive and structurally sound heat pipe cooling feature which makes the piston skirts approximately isothermal and enhances cooling of the piston crown.

The heat pipe has two purposes. First, it is intended to make a piston assembly more isothermal to control thermal distortions. The reduced distortions make the piston skirts more effective as full-film bearings in a design the inventor and his associates are developing. Secondly, the heat piped piston arrangement is intended to reduce peak metal temperatures and therefore increase material strengths. This allows the heat piped pistons to be built with less weight and/or better durability than is possible with current pistons to improve engine performance.

A heat pipe is a sealed volume, often including a wick capillary arrangement, which contains a working liquid in equilibrium with its own vapor. Noncondensable gases are excluded from the volume. Since the only vapor in the volume is the vapor of the working liquid itself, the liquid interface is always simultaneously at its boiling and condensing temperature for the pressure in the volume. If any part of the internal surface area of the enclosure is cooler than the liquid surfaces elsewhere inside the heat pipe enclosure, this cooler surface will condense vapor upon itself. This condensation will lower the vapor pressure in the heat pipe volume. In response, evaporation will occur off of the liquid surfaces which are slightly warmer, and the vapor will flow hydrodynamically at tiny pressure drops to the condensing surface. This condensing surface will be rapidly heated by the latent heat of vaporization of the vapor which condenses upon it. Thermal equilibration between surfaces is rapidly achieved in this way.

Similarly, if a liquid contacting surface is hotter than other areas in the heat pipe volume, the hotter surface will evaporate liquid and be cooled by the heat of vaporization of the evaporated liquid. So long as the heat pipe enclosure surfaces stay wet, heat transfer rates within the heat pipe passage will be extremely high. The heat transfer rates inside a heat pipe volume are so long that for most analytical purposes a heat pipe may be analyzed as an isothermal volume.

The limiting heat transfer rate in a heat pipe is roughly proportional to the vapor pressure of its working liquid as a function of temperature. If the heat pipe is heated to the point where all the liquid in the heat pipe evaporates, heat transfer stops since the evaporation process ceases. Therefore, heat pipes must be designed so there is always some unevaporated liquid in them at their maximum operating temperature.

Heat transfer rates required to cool a piston with a heat pipe are possible with a wide range of working liquids, and some of these working liquids will operate with peak vapor pressures not much in excess of atmospheric pressure in the temperature range required (200° to 400° F.). For this reason, the heat pipe containing structure can be made to be thin, light and flexible if the proper working liquid is chosen for the heat pipe.

It is desirable that the heat pipe arrangement for a piston be thin, light, and flexible. Lightness is desirable because the piston is subjected to high inertial forces (of the order of several thousand G's in racing applications). Flexibility is desirable so that the heat piped passage can be fastened to the inside of the piston easily and inexpensively. A light flexible heat piped structure can be fastened to the inside of the piston skirts and the inside of the piston crown by means of a thin high conductance elastomer-glue type layer to have intimate thermal contact with the piston crown and the piston skirts. The elastomer can be made thin enough that thermal resistance across the elastomer layer is small. The elastomeric connection between the heat pipe structure and the piston structure eliminates (actually buffers) stress concentrations due to strain buildups, and eliminates the need for precise geometrical matching between heat pipe geometry and piston geometry. For a thin and light heat pipe structure, the strength of an elastomer bond is ample to hold the heat pipe in place in the presence of the inertial stresses to which the heat pipe will be subjected. The elastomeric bonding process between heat pipe and piston per se is also inexpensive and lends itself to high volume mass production techniques.

A practical and inexpensive heat piped piston can be built as follows.

IN THE DRAWINGS

DETAILED DISCUSSION

Figure 1:
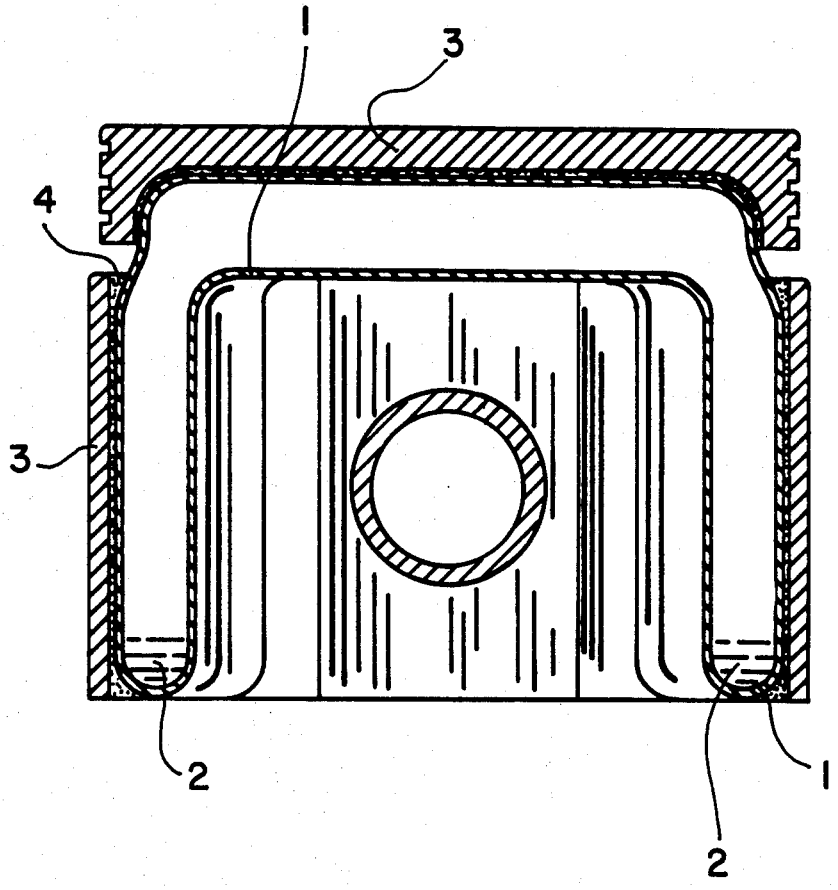
FIG. 1 is a central, cross sectional view of a heat pipe equipped piston, showing the installation.

FIG. 1 shows a central, cross sectional view of a heat pipe equipped piston. Hollow, thin, metallic heat pipe capsule 1 contains a small volume of working liquid 2 (which may be decane, $C_{10}H_{22}$, or a similar boiling point material). The hollow heat pipe capsule is evacuated so that the only vapor it contains is the vapor of its working liquid. Heat transfer to the piston is only significant when the engine is running. Under running conditions inertial forces slosh the fluid inside the heat pipe so that it is not necessary to have internal wicking inside heat pipe capsule 1. The volume relations between the heat pipe capsule 1 and the working liquid 2 are arranged so that under all operating conditions sufficient liquid phase working fluid remains to keep the heat pipe evaporation-condensation process operational. This usually requires that the liquid volume be 2–3% of the heat pipe volume. The heat pipe 1 is elastomerically mounted to piston 3 by means of metal-filled elastomeric material (for example silicone rubber) 4, which acts both as an adhesive and as a buffer for differential expansion and geometrical imperfections of mating between the piston surface and the heat piped surface. The metal filled elastomer has high enough thermal conductance to assure rapid heat transfer between the piston surfaces and the heat pipe capsule. Tests have been conducted which assure Automotive Engine Associates that the silicone rubber elastomeric mounting will have sufficient strength to hold the heat pipe under the maximum inertial stresses likely in the engine. In operation, heat transferred from combustion gases to the piston crown is transferred via metal-filled elastomer 4 to the upper surface of heat piped capsule 1, where heat is absorbed by evaporation of the working liquid. The vapor flows at very small pressure differentials to the relatively cooler surfaces of the piston skirt, where it condenses giving up its latent heat of vaporization to the piston skirts. Consequently, it is expected that the metal surfaces of heat pipe 1 will be nearly isothermal, and will transfer heat so rapidly that the piston to which the heat pipe is mounted will be much more nearly isothermal than has been the case for prior art pistons.

In the piston design of FIG. 1, the bulk of the heat transfer to the coolant will occur through the oil film separating the piston skirts from the cylinder wall. For this reason, the heat transfer load across the piston rings will be much reduced from current practice. This reduction in heat transfer load on the rings permits improved lubrication characteristics in piston rings currently under development at Automotive Engine Associates.

Figure 2:
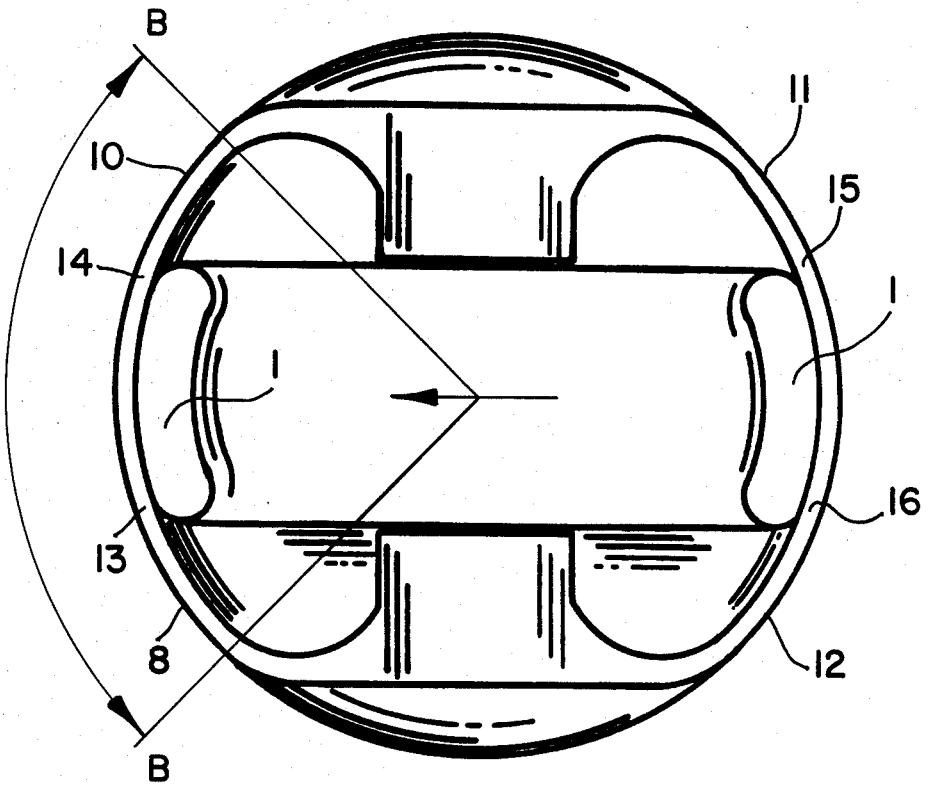
FIG. 2 is a view of the heat pipe equipped piston from the bottom.

FIG. 2 is a view of the heat pipe equipped piston viewed from the bottom (from the piston skirt rather than the piston crown side). As can be seen, the heat pipe capsule fits between the wrist pin supporting bosses and transfers heat to the piston skirts. In the design of the drawing, the heat pipe does not transfer heat around the entire arc B—B of the piston skirts. Areas of the skirts 8, 10, 11 and 12 which are not directly in contact with heat pipe 1 are in close thermal contact with portions of the skirts 13, 14, 15 and 16 which are in direct contact. Sections 9, 10, 11 and 12 will rapidly absorb heat by conduction from the heat pipe and will assist in heat transfer through the oil layer to the cylinder wall. The geometry of the heat pipe 1 can, of course, be changed to contact an increased portion of the skirts.

Figure 3:
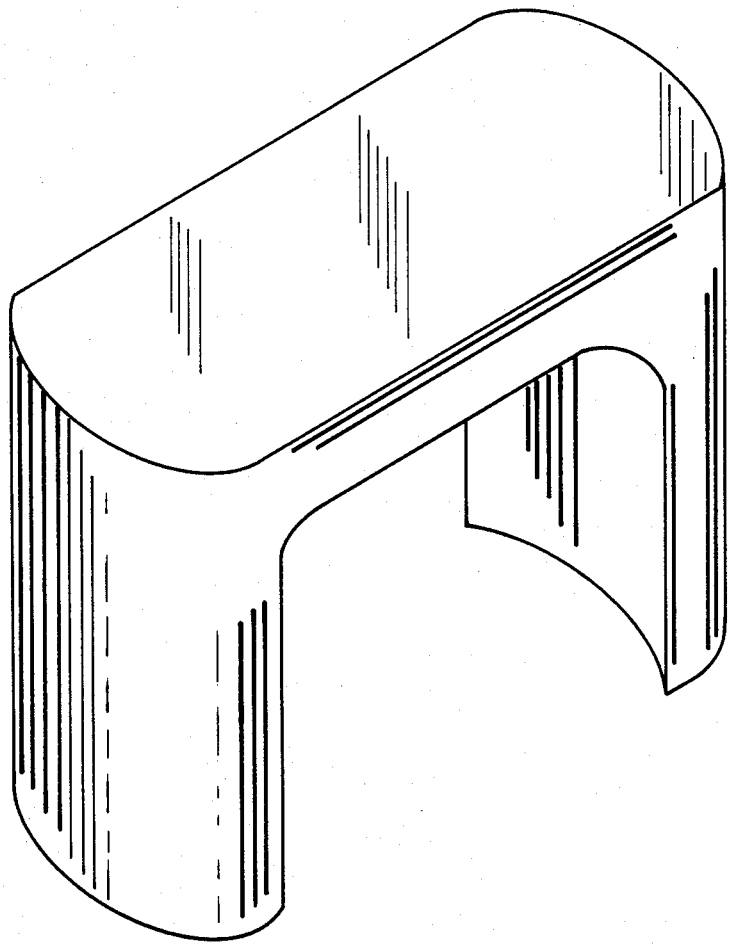
FIG. 3 is an isometric view of the heat pipe itself.

FIG. 3 is an isometric view of the heat pipe itself prior to installation. The heat pipe is to be manufactured, if possible, of thin aluminum sheet, and is to be evacuated and sealed using standard mass production welding techniques. A very high vacuum inside the heat pipe capsule is not necessary, but it is desirable to eliminate as much of the noncondensible gas as possible inside the heat pipe capsule 1. It is, therefore, desirable to evacuate the heat pipe under conditions where the working fluid (which may be decane or a like boiling point liquid) is not, itself, vaporized. This can be arranged by installing the decane in a heat-sealed polyethylene tube, so that the evacuation of the heat pipe prior to welding can occur without contamination of the vacuum pump with decane. Upon initial operation of the piston, the polyethylene should melt, freeing the working liquid for function.

Those skilled in the art of heat pipes will recognize that many modifications of the heat piped piston are possible. The material used to construct heat pipe capsule 1 can be a number of metals and other materials. The choice of working fluid for the heat pipe can be varied. Some internal structure to reinforce heat pipe capsule 1 may be desirable, particularly if a working fluid is chosen which operates at a high pressure at working temperatures. To keep the heat pipe container light, a working fluid which operates at low pressures is desirable.

Using a heat piped piston, it is possible to design a piston structure which is nearly isothermal. Such a piston has predictable expansion characteristics and produces a much lower heat transfer load on the rings.

It is claimed:

1. A piston adapted for use in a reciprocating piston internal combustion engine having a cylinder for carrying same, said piston including a crown portion with a cylindrical skirt extending downwardly therefrom, a hole below the crown portion perpendicular to the vertical axis of the piston adapted to receive a wrist pin, said skirt having two thrust faces which function as bearings in interaction with a wall of the cylinder to take thrust forces generally perpendicular to both said wrist pin hole axis and said cylinder central axis, said thrust faces having opposed internal surfaces extending across its entire axial length, the crown portion having an internal surface connected to the internal surfaces of the thrust faces, and means for providing extremely rapid heat transfer from the piston crown portion to the piston skirt, said means comprising:

a thin flexible hollow capsule partially filled with a liquid adapted for evaporation and condensation at piston operating temperatures said hollow capsule having surfaces shaped to fit closely against only the internal surface of the piston crown portion and the opposed internal surfaces of the thrust faces of said piston skirt, said hollow capsule being bonded to the said internal surfaces by a thin elastomeric layer of high thermal conductance whereby a high conductance heat transfer path is established between the piston crown and the piston skirt thrust faces, to provide generally isothermal conditions throughout the piston at all operating conditions.

2. The invention as set forth in claim 1 and wherein said liquid partially filling said hollow capsule is an essentially pure compound.

3. The invention as set forth in claim 1 and wherein the volume of said hollow capsule is evacuated of gases which are noncondensable at piston operating temperature under ambient conditions internal to said hollow capsule.

* * * * *